US005951175A

United States Patent [19]

Kawamori

[11] Patent Number: 5,951,175

[45] Date of Patent: Sep. 14, 1999

[54] THERMAL PRINTER

[75] Inventor: Masami Kawamori, Chofu, Japan

[73] Assignee: NEC Corporation, Tokyo, Japan

[21] Appl. No.: 09/261,019

[22] Filed: Mar. 2, 1999

[30] Foreign Application Priority Data

Mar. 5, 1998 [JP] Japan ..... 10-069263

[51] Int. Cl.[6] ..... B41J 2/315

[52] U.S. Cl. ..... 400/120.01; 347/211; 347/171

[58] Field of Search ..... 400/120.01, 120.08; 347/171, 211

[56] References Cited

U.S. PATENT DOCUMENTS

| | | | |
|---|---|---|---|
| 4,500,893 | 2/1985 | Sakura et al. | 347/211 |
| 4,595,935 | 6/1986 | Brooks et al. | 347/171 |
| 4,769,657 | 9/1988 | Takahashi | 347/171 |
| 4,774,526 | 9/1988 | Ito | 606/204.45 |
| 4,996,487 | 2/1991 | McSparran et al. | 403/24 |
| 5,608,442 | 3/1997 | Bennefeld et al. | 347/211 |

FOREIGN PATENT DOCUMENTS

| | | |
|---|---|---|
| 57-123073 | 7/1982 | Japan . |
| 60-159662 | 8/1985 | Japan . |
| 6-106759 | 4/1994 | Japan . |
| 10-69263 | 5/1998 | Japan . |
| 63-191657 | 8/1998 | Japan . |

OTHER PUBLICATIONS

Japan Patent No. 07–329334, Kokai, Dec. 19, 1995; Japan Utility Model Kokai No. 59–184644, Dec. 8, 1984; Japan Utility Model Kokai No. 01–138744, Sep. 21, 1989.

*Primary Examiner*—Edgar Burr
*Assistant Examiner*—Minh H. Chau
*Attorney, Agent, or Firm*—J. Warren Whitesel; Laff, Whitesel & Saret

[57] ABSTRACT

A thermal printer has a thermal head in which a FET is connected in series to an individual heater element of each of heater element groups which are connected in parallel with each other, and to which one capacitor for smoothing a power and eliminating a noise is connected in parallel relative to the heater element group. The thermal head performs printing on a thermal paper. The thermal printer includes a printing power source circuit, a failure detection power source circuit, a failure detection circuit for detecting a presence and absence of the failure of the heater element by comparing a voltage generated at opposite ends of the detecting resistor with a threshold value. FET control means is provided for causing discharging of the capacitor by simultaneously turning on all of the FET under the condition where the printing power source circuit and the failure detection power supply circuit are turned off, before the voltage is supplied from the failure detection power source circuit to the thermal head and the failure detection is performed.

1 Claim, 2 Drawing Sheets

THERMAL PRINTER

BACKGROUND OF THE INVENTION

1. Field of the Invention

The present invention relates to a thermal printer.

2. Description of the Related Art

Among thermal heads employed in a heat transfer printer/a thermal printer, there is the thermal head to which a capacitor for smoothing a power and eliminating a noise is mounted. Upon performing a failure detection of a heater element, it becomes possible to accurately detect a failure by discharging the capacitor.

Typically, in order to cause discharging of the capacitor, a dedicated discharge circuit is provided to discharge the capacitor as disclosed in the Japanese Unexamined Utility Model Publication No. Heisei 1-138744.

Accordingly, it encounters a problem to complicate a circuitry and a control. Furthermore, upon detecting the failure, it can unwantedly cause color development of a printing paper in case that the printing paper is held in contact with the thermal head.

SUMMARY OF THE INVENTION

Therefore, it is an object of the present invention to provide a thermal printer which can immediately discharge a capacitor without employing the dedicated capacitor discharge circuit and developing the color of the printing paper, and accurately detect the abnormality and the failure of a heater element group.

According to one aspect of the present invention, a thermal printer including a thermal head in which a FET is connected in series to an individual heater element of each of heater element groups which are connected in parallel with each other, and to which one capacitor for smoothing a power and eliminating a noise is connected in parallel relative to the heater element group, the thermal head performing printing on a thermal paper, comprising:

- a printing power source circuit for supplying a given voltage of an electric power to the thermal head for performing printing;
- a failure detection power source circuit for supplying a given voltage of an electric power to the thermal head, which given voltage is lower than the printing power source circuit via a detecting resistor upon detecting the failure;
- a failure detection circuit for detecting a presence and absence of the failure of the heater element by comparing a voltage generated at opposite ends of the detecting resistor with a threshold value; and
- FET control means for causing discharging of the capacitor by simultaneously turning on all of the FET under the condition where the printing power source circuit and the failure detection power supply circuit are turned off, before the voltage is supplied from the failure detection power source circuit to the thermal head and the failure detection is performed.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
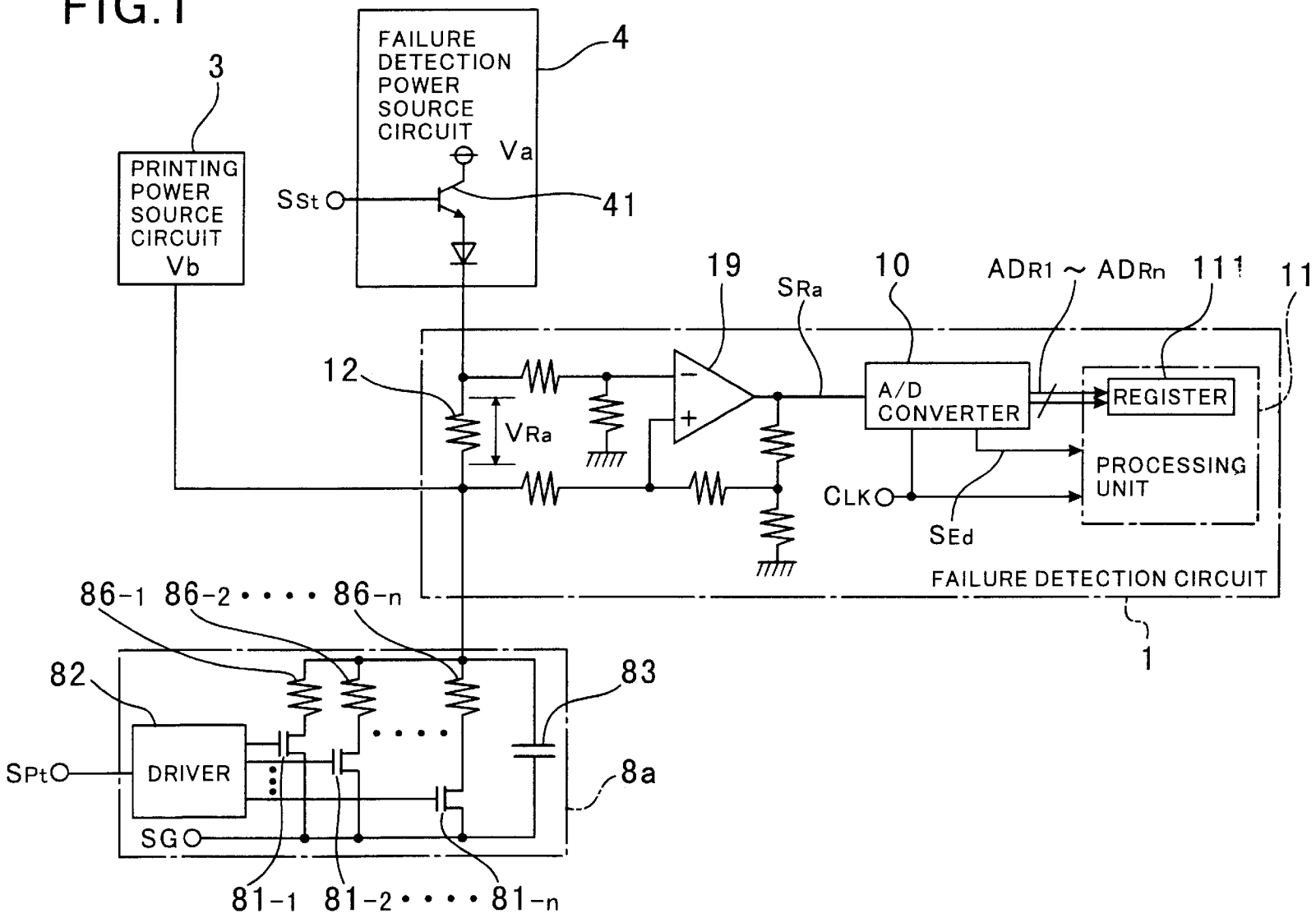
FIG. 1 is an electric circuit diagram of the preferred embodiment of a thermal printer according to the present invention.

FIG. 1 is a circuit diagram showing the structure of the preferred embodiment of a thermal printer according to the present invention.

The shown embodiment of the thermal printer has a thermal head 8*a*, a printing power source circuit 3 for supplying an electric power to a thermal head 8*a* upon performing printing operation, a failure detection power source circuit 4 for supplying an electric power to the thermal head 8*a* upon performing the failure detection, and a failure detection circuit 1.

In the thermal head 8*a*, FETs (Field Effect Transistors) $\mathbf{81}_{-1}$ to $\mathbf{81}_{-n}$ are connected in series with respective of individual heater elements of heater element groups $\mathbf{86}_{-1}$ to $\mathbf{86}_{-n}$ which are connected in parallel with each other. These FET $\mathbf{81}_{-1}$ to $\mathbf{81}_{-n}$ are adapted to be selectively turned on and off by a driver 82 as FET control means. Furthermore, one capacitor 83 is connected in parallel relative to the circuit constructed by the heater element group $\mathbf{86}_{-1}$ to $\mathbf{86}_{-n}$ and the FET group $\mathbf{81}_{-1}$ to $\mathbf{81}_{-n}$, serving for smoothing a power and eliminating a noise.

The failure detection circuit 1 has a detecting resistor 12 connected between the failure detection power source circuit 4 and the thermal head 8*a*, an operational amplifier 19 for amplifying a voltage VRa generated at opposite ends of the detecting resistor 12, an A/D converter 10 for converting an output of the operational amplifier 19 to a digital value, and a processing unit 11 such as a CPU for making judgment of the presence and absence of the failure per each heater element $\mathbf{86}_{-1}$ to $\mathbf{86}_{-n}$ by storing a register 111 with the digital value $AD_{R1}$ to $AD_{Rn}$ per each heater element $\mathbf{86}_{-1}$ to $\mathbf{86}_{-n}$ output from the A/D converter 10 and comparing with the threshold value.

Next, an operation will be discussed with reference to a timing chart in FIGS. 2(*a*) to 2(*g*) in conjunction with FIG. 1.

In case that the detection of the failure of the heater element group $\mathbf{86}_{-1}$ to $\mathbf{86}_{-n}$ is performed immediately after the printing operation is performed, an electric charge is accumulated in the capacitor 83, because a voltage Vb for developing the color is supplied from the printing power source circuit 3.

Figure 2:
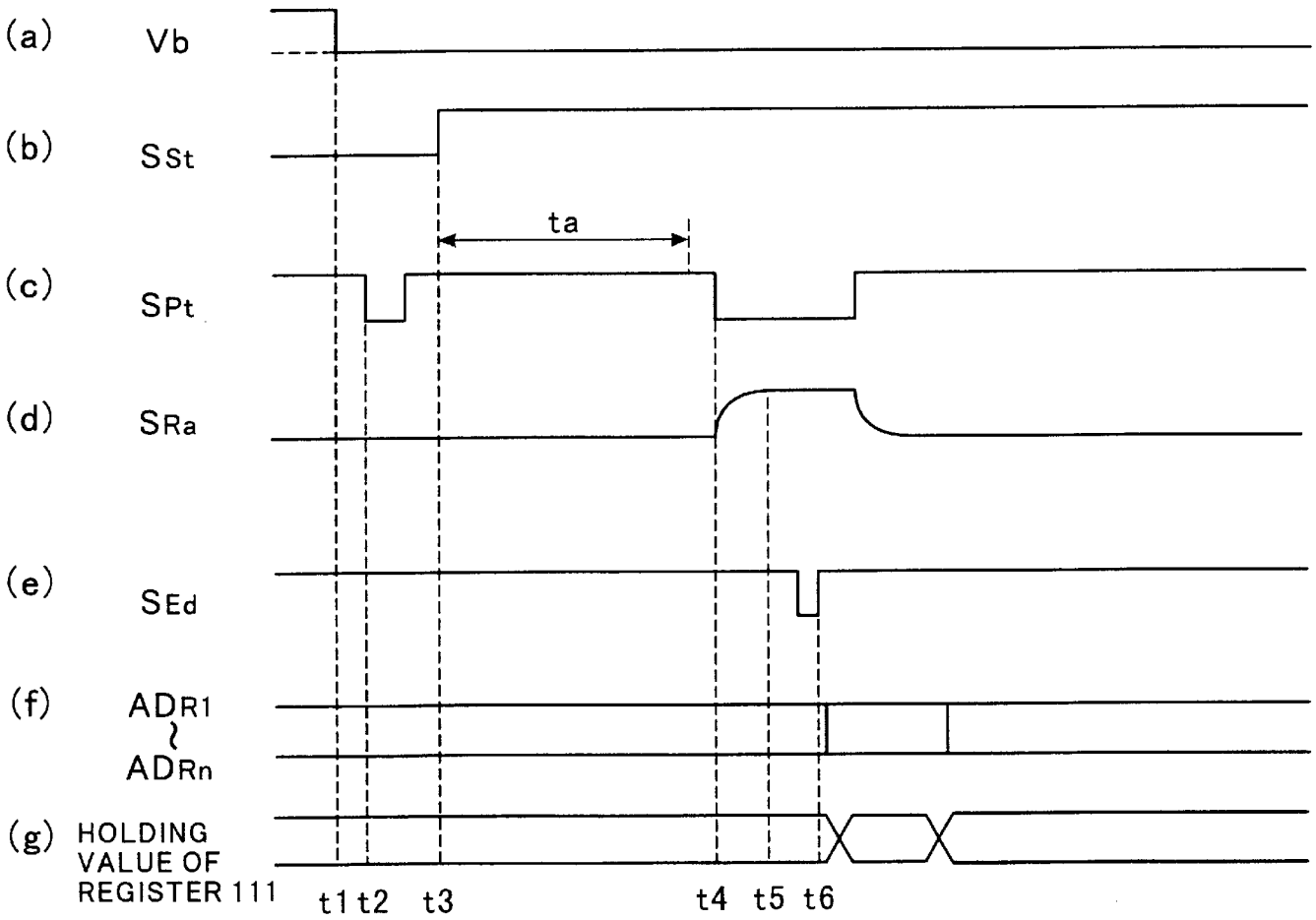
FIGS. 2(*a*) to 2(*g*) are timing charts of an operation of the preferred embodiment of the thermal printer shown in FIG. 1.

Accordingly, the electric charge accumulated in the capacitor 38 is discharged by simultaneously turning on all of the FET $\mathbf{81}_{-1}$ to $\mathbf{81}_{-n}$ by the driver 82 of the thermal head 8*a*, and simultaneously applying a printing signal to all of the heater element group 86$_{-1}$ to 86$_{-n}$ (applying a dummy signal), under the condition where the failure detection circuit 1 and the printing power source circuit 3 (FIG. 2(*a*)) are tuned off before the failure detection is performed, and the failure detection power source circuit 4 is also placed into off-state (placing a transistor 41 into off-state).

By this, it becomes possible to discharge the electric charge accumulated in the capacitor 83 without providing the discharge circuit for discharging the electric charge of the capacitor 83 such as, a circuit of the combination of the discharge resistance and a switch. Therefore, it becomes possible to significantly shorten the discharge duration.

Next, assuming that a period longer than or equal to ta after inputting of a failure detection trigger signal Sst to the failure detection power source circuit 4 is waited as a period required for stabilizing a detection voltage Va, and thereafter, detection of presence or absence of failure of the first heating element 86$_{-1}$ is performed, for example, the printing signal Spt (FIG. 2(*c*)) to be supplied only the heater element 86$_{-1}$ is input to the thermal head 8*a*. When the printing signal Spt is input, the driver 82 turns on only the first FET 81$_{-1}$. At this time, the detection voltage Va which is lower than the voltage Vb output from the printing power source circuit 3 is output from the failure detection power source circuit 4, so that the current flows into the detecting resistor 12 to generate the voltage VRa at opposite ends of the detecting resistor 12.

At this time, it makes a difference in the voltage VRa due to whether the heater element 86$_{-1}$ is normal or not (the voltage VRa becomes lower according to the progress of fatigue of the heater element). However, it makes only a little difference, because the detection voltage Va is set as a low voltage in order to avoid developing the color of the printing paper. Accordingly, the voltage VRa is amplified by the operational amplifier 19.

A voltage SRa (FIG. 2(*d*)) amplified by the operational amplifier 19 is supplied to the A/D converter 10. Therefore, an analog signal is converted into a digital data $AD_{R1}$. The digital data value thus converted is compared with the threshold value previously set in the processing unit 11. When the data value is less or equal to the threshold value, the heater element 86$_{-1}$ is judged to be out of order.

In the operational amplifier 19, the voltage VRa at opposite ends of the detecting resistor 12 is amplified, and the voltage SRa is supplied to the A/D converter 10. However, it takes time to set-up the voltage due to the integral by the capacitor 83 of the thermal head 8*a* (FIG. 2(*d*)).

Therefore, in the preferred embodiment of the present invention, the timing for starting the digital conversion is delayed by the A/D converter 10 (t5). It should be noted that only the timing for starting the digital conversion by the heater element for starting the failure detection (for example, 86$_{-1}$) is delayed, when the failure detection of the heater element is continuously performed. Because, the detection voltage Va is already stable from the second time (for example, the second heater element 86$_{-2}$) onward.

After the detection of the presence and absence of the abnormality is finished with respect to the first heater element 86$_{-1}$, the printing signal Spt supplied to only the second heater element 86$_{-2}$ is supplied to the thermal head 8*a*, and the failure detection is similarly performed. Furthermore, such a processing is repeatedly performed up to the final heater element 86$_{-n}$.

Therefore, since it is unnecessary to discharge the electric charge accumulated in the capacitor 83 per the heater element, it becomes possible to shorten the time for detecting the failure in comparison with the discharge per the heater element by the dedicated discharge circuit.

In the construction as set forth above, the electric charge accumulated in the capacitor for smoothing the power and eliminating the noise, which has an effect upon performing the failure detection of the heater element, can be discharged by simultaneously turning on all of the FET (the dummy apply) without providing the special discharge circuit (for example, the circuit of the combination of the discharge resistance and the switch) to immediately discharge the capacitor. Therefore, it becomes possible to shorten the discharge duration to a large extent in comparison with the prior art without developing the color of the printing paper.

Furthermore, when the failure detection is performed, it is possible to avoid developing the color of the printing paper upon detecting the failure by switching to the low voltage. It is also possible to shorten the time for detecting the failure in comparison with the prior art, since it is unnecessary to discharge the capacitor per the heater element.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A thermal printer including a thermal head in which a FET is connected in series to an individual heater element of each of heater element groups which are connected in parallel with each other, and to which one capacitor for smoothing a power and eliminating a noise is connected in parallel relative to said heater element group, said thermal head performing printing on a thermal paper, comprising:

a printing power source circuit for supplying a given voltage of an electric power to said thermal head for performing printing;

a failure detection power source circuit for supplying a given voltage of an electric power to said thermal head, which given voltage is lower than said printing power source circuit via a detecting resistor upon detecting the failure;

a failure detection circuit for detecting a presence and absence of the failure of said heater element by comparing a voltage generated at opposite ends of said detecting resistor with a threshold value; and FET control means for causing discharging of said capacitor by simultaneously turning on all of said FET under the condition where said printing power source circuit and said failure detection power supply circuit are turned off, before said voltage is supplied from said failure detection power source circuit to said thermal head and the failure detection is performed.

* * * * *